United States Patent [19]

Tabata et al.

[11] 3,965,238

[45] June 22, 1976

[54] METHOD OF RECOVERING URANIUM

[75] Inventors: Tomokazu Tabata; Tetsuo Ikushige, both of Shin Nanyo, Japan

[73] Assignee: Toyo Soda Manufacturing Co., Ltd., Yamaguchi, Japan

[22] Filed: July 27, 1973

[21] Appl. No.: 383,246

[30] Foreign Application Priority Data

July 31, 1972 Japan ..... 47-75965

[52] U.S. Cl. ..... 423/8; 423/18; 423/21; 423/24; 423/34; 423/42; 423/55; 423/63; 423/65; 423/70; 423/85; 423/112; 423/122; 423/157; 423/158

[51] Int. Cl.[2] ..... B01D 11/04

[58] Field of Search ..... 423/8, 18, 21, 24, 34, 423/42, 55, 63, 65, 70, 85, 112, 122, 157, 158

[56] References Cited

UNITED STATES PATENTS

| | | | |
|---|---|---|---|
| 2,743,157 | 4/1956 | Hagemann | 423/8 |
| 2,859,092 | 11/1958 | Bailes et al. | 423/10 |
| 2,882,123 | 4/1959 | Long | 423/10 |
| 2,901,314 | 8/1959 | Vavalides | 423/8 |
| 2,953,432 | 9/1960 | Hart et al. | 423/8 |
| 2,978,294 | 4/1961 | Hyde et al. | 423/8 |
| 3,052,514 | 9/1962 | Schmitt | 423/10 |
| 3,320,033 | 5/1967 | Goren | 423/8 |
| 3,825,649 | 7/1974 | Gresky et al. | 423/10 |

*Primary Examiner*—Benjamin R. Padgett
*Assistant Examiner*—B. Hunt
*Attorney, Agent, or Firm*—Oblon, Fisher, Spivak, McClelland & Maier

[57] ABSTRACT

Uranium values are obtained from phosphate rock by acidifying phosphate rock containing uranium values and at least one other heavy metal with a mineral acid so as to obtain a crude acid, solvent extracting the crude acid with an organic solvent so as to separate a raffinate from a relatively pure, wet process phosphoric acid and treating said raffinate with a base so as to raise the pH to 1–2 whereby uranium hydroxide or phosphate and other heavy metal hydroxides or phosphates are coprecipitated. The uranium content of the coprecipitate after drying is at least as high as 0.3% which is comparable to that of uranium ores of the highest quality.

6 Claims, No Drawings

METHOD OF RECOVERING URANIUM

BACKGROUND OF THE INVENTION

1. Field of the Invention:

This invention relates to an effective process for recovering uranium from a raffinate containing 10 to 100 mg/l of uranium by coprecipitation with large amounts of the hydroxides or phosphates of other heavy metals at low pH. In this case, the term raffinate is the residual phase which forms after acidulating phosphate rock with a mineral acid such as sulfuric, hydrochloric or nitric acid, and then treating the resulting crude acid with an organic solvent.

2. Description of the Prior Art:

The recent, rapid increase in demand for nuclear power generation facilities has prompted a corresponding increase in the demand for uranium, and because of this demand, future shortages of uranium are expected to occur. For this reason, refining of low quality uranium ores, the recovery of uranium from sea water or from waste liquors and other processes are being studied in many countries. In the present practices of the uranium industry, the lower concentration limit of uranium in ore below which it is uneconomical to attempt to extract uranium from ore is about 0.1%.

Presently, uranium containing ores are treated by conventional processes which begin with leaching of the ores with sulfuric acid or sodium carbonate solutions. The leaching step of the processes is followed by concentration of the extract and further refining by ion exchange or solvent extraction techniques. However, great difficulty is encountered when these methods are used to separate small amounts of uranium from large amounts of other metal ions in concentrated mineral acids. Therefore, attempts have been made to develop techniques which are successful in the extraction of uranium from low grade materials. Several techniques have been developed for the separation of uranium from very dilute solutions such as by precipitating uranium complexes from solution by treatment with organic reagents such as oxine or cupferron; by using inorganic absorbents such as titanium hydroxide, ferric hydroxide or the like; by treatment of the solutions with chelating resins; and by treating the dilute solutions with an ionic surface active agent which results in the formation of insoluble uranium compounds through flotation that are separated by bubbling the solution with air. Further, such techniques as ion exchange, solvent extraction and other recovery processes have also been reported. However, none of these processes have been entirely satisfactory.

A need, therefore, continues to exist for a process which is economically and industrially feasible for the separation of uranium from low grade ores or from dilute solutions.

SUMMARY OF THE INVENTION

Accordingly, one object of the present invention is to provide a process for the separation of uranium from dilute solutions or low grade ores.

Briefly, this object and other objects of the invention, as hereinafter will become more readily apparent, can be attained by a process of recovering uranium values from phosphate rock by acidifying phosphate rock containing uranium values and at least one other heavy metal with a mineral acid so as to obtain a crude acid, solvent extracting the crude acid with an organic solvent so as to separate a raffinate from a relatively pure, wet process phosphoric acid and treating said raffinate with a base so as to raise the pH to 1–2 whereby uranium hydroxide or phosphate and other heavy metal hydroxides or phosphates are coprecipitated.

DETAILED DESCRIPTION OF THE PREFERRED EMBODIMENTS

In the process of the invention, a crude phosphoric acid solution is formed by the acidification of a phosphate rock with a mineral acid such as hydrochloric acid, sulfuric acid or nitric acid containing from 0.01 to 0.02% uranium. A raffinate which is a 0.2–2 mole/l mineral acid solution containing from 0.001 to 0.01% uranium is prepared by extracting the crude phosphoric acid solution and separating it from the relatively pure, wet process phosphoric acid obtained with an aliphatic alcohol such as n-butanol or isoamyl alcohol, a cycloaliphatic alcohol such as cyclohexanol or an ester. The raffinate contains from 10 – 100 mg/l of uranium and a total of at least 10 g/l of heavy metals such as iron, aluminum, calcium, copper, zinc, titanium, vanadium, nickel, rare earth metals, molybdenum, magnesium and manganese. It has been found that when an aqueous alkali solution is added gradually to the raffinate, metal hydroxides of metals such as of iron, aluminum, calcium and magnesium begin to precipitate as a sludge at low pH. The small amounts of sludge which form coprecipitate with all of the uranium which is present in the raffinate. Suitable alkali solutions include sodium and potassium hydroxide solutions. However, from an economic viewpoint, milk of lime is preferred.

When the raffinate is treated with an alkali solution, about 36% of the uranium coprecipitates at pH 1 while 100% of the uranium coprecipitates at pH2. Other heavy metals precipitate from the solution as the phosphate or hydroxide compounds thereof. Analysis of the precipitate obtained at pH2, after drying, shows that it contains a uranium content of 0.35%. This concentration is comparable to the highest concentration levels of uranium found in uranium ores currently used. The large amounts of metallic impurities in the raffinate include compounds of iron, aluminum, and calcium (each in concentrations of over 1 g/l), copper, chromium, zinc, titanium, vandium, nickel, rare earth metals, molybdenum, magnesium, and the like. This uranium-containing precipitate obtained can be dried and then is leached in autoclaves or in Pachuca tanks with a mixed solution of sodium carbonate and sodium bicarbonate. The leached solution in turn is then subjected to an ion exchange or precipitation treatment, and the solid material obtained is dried and a yellow cake-like solid is obtained.

Having generally described this invention, a further understanding can be obtained by reference to certain specific examples which are provided herein for purpose of illustration only and are not intended to be limiting unless otherwise specified.

EXAMPLE 1

A raffinate of the following composition was used in this example.

| | | |
|---|---|---|
| HCl | 60 | g/l |
| $H_3PO_4$ | 10 | g/l |

-continued

| | | | |
|---|---|---|---|
| U | 65 | mg/l | |
| Fe | 2,200 | mg/l | more than 10 g/l (each calculated as the metal) |
| Al | 2,600 | mg/l | |
| Ca | 1,800 | mg/l | |
| Mg | 900 | mg/l | |
| Other metals* | | | |

*Include Cu, Cr, Mn, Ti, Mo, V, rare earth metals, and the like.

To this raffinate (Sp. Gr. at 20 C, 1.058) was added 170 g/l of milk lime until the pH was adjusted to 1, and the precipitate which formed was filtered. After drying the precipitate at 110°C for 2 hours, the precipitate was dissolved in 6 Molar hydrochloric acid and then passed through an anion exchange resin to separate the uranium. The uranium containing solution obtained was colorimetrically analyzed with the sodium salt of o-arsonophenyl azochromotropic acid as the colorimetric reagent. The same process was repeated at a pH of 2. The results of the two experiments are tabulated in Table 1. The data indicates that at a pH of from 1–2, a dry cake-like solid containing from 0.35 to 0.66% uranium is obtained.

Table 1

| pH | Amount of precipitate g from raffinate 1 | Amount of uranium in precipitate mg from raffinate 1 | Amount of uranium/ amount of precipitate (wt.%) |
|---|---|---|---|
| 1 | 3.5 | 23.5 | 0.66 |
| 2 | 19.0 | 65 | 0.35 |

COMPARATIVE EXAMPLE 1

The process described in Example 1 was repeated until a pH of 3 or higher was obtained. The results are shown in Table 2.

Table 2

| pH | Amount of precipitate g from raffinate 1 | Amount of uranium in precipitate mg from raffinate 1 | Amount of uranium/ amount of precipitate (wt.%) |
|---|---|---|---|
| 3 | 38.5 | 65 | 0.17 |
| 5 | 45.8 | 65 | 0.14 |
| 7 | 58.9 | 65 | 0.12 |
| 9 | 60.3 | 65 | 0.11 |

Note: At a pH of 3, most of the iron, aluminum, titanium, vanadium and molybdenum had precipitated while manganese, zinc, and nickel had not precipitated. Furthermore, about one-half of the magnesium, calcium, copper and chromium had precipitated. Emission spectrographic measurements showed that no rare earth metals were present in the material obtained.

Table 2 clearly shows that no more uranium is obtained from solution at a pH of 3 or higher.

EXAMPLE 2

The process described in Example 1 was repeated except that solid sodium hydroxide was used instead of milk or lime. The results are shown in Table 3.

Table 3

| pH | Amount of precipitate g from raffinate 1 | Amount of uranium in precipitate mg from raffinate 1 | Amount of uranium/ amount of precipitate (wt.%) |
|---|---|---|---|
| 1 | 4.0 | 23.2 | 0.58 |
| 2 | 19.0 | 65.0 | 0.35 |

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for recovering uranium values from a phosphate rock which comprises 1. acidifying a phosphate rock containing uranium values and at least one other metal value, with a mineral acid so as to obtain a crude acid,
2. solvent extracting said crude acid with an organic solvent so as to separate a raffinate from a relatively pure, wet process, phosphoric acid, and
3. treating said raffinate with an alkali so as to raise the pH to 1–2, whereby uranium hydroxide or phosphate and other heavy metal hydroxides or phosphates are coprecipitated.

2. The process of claim 1, wherein said waste raffinate is a 0.2–2 mole/l mineral acid solution.

3. The process of claim 1, wherein said mineral acid is sulfuric, hydrochloric or nitric acid.

4. The process of claim 1, wherein said alkali is sodium hydroxide, potassium hydroxide or milk of lime.

5. The process of claim 1, wherein said raffinate contains coprecipitated metals in a total of at least 10g/l of aluminum, calcium copper, chromium, zinc, titanium, vanadium, nickel, the rare earth metals, molybdenum, magnesium, and manganese, or at least one of these metals.

6. The process of claim 1, wherein said raffinate contains from 10–100 mg/l of uranium.

* * * * *